United States Patent [19]

Murao

[11] Patent Number: 4,532,682

[45] Date of Patent: Aug. 6, 1985

[54] CONNECTION FOR A JEWELRY BAND

[75] Inventor: Masami Murao, Tokyo, Japan

[73] Assignee: Kabushiki Kaisha Murao Shoten, Tokyo, Japan

[21] Appl. No.: 531,699

[22] Filed: Sep. 13, 1983

[30] Foreign Application Priority Data

Sep. 17, 1982 [JP] Japan ..... 57-139942

[51] Int. Cl.[3] ..... A44B 11/25; A44C 5/08

[52] U.S. Cl. ..... 24/616; 24/618; 24/589; 24/598; 63/4

[58] Field of Search ..... 24/616, 618, 589, 598, 24/116 A; 63/4

[56] References Cited

U.S. PATENT DOCUMENTS

| | | | |
|---|---|---|---|
| 627,300 | 6/1899 | Habicht | 24/616 |
| 2,513,592 | 7/1950 | Silverman | 24/616 |
| 2,986,792 | 6/1961 | Wyatt | 24/616 |
| 3,092,885 | 6/1963 | Guanche | 24/589 |
| 3,848,299 | 11/1974 | Gray | 24/616 |
| 4,170,809 | 10/1979 | Geldwerth et al. | 24/616 |
| 4,426,854 | 1/1984 | Geldwerth et al. | 24/616 |

FOREIGN PATENT DOCUMENTS

| | | | |
|---|---|---|---|
| 229609 | 10/1963 | Austria | 24/616 |

*Primary Examiner*—Victor N. Sakran

*Attorney, Agent, or Firm*—Shlesinger, Arkwright, Garvey & Fado

[57] ABSTRACT

A connection for a jewelry band including a male clasp member and a female clasp member. A resilient detent member in the form of a leaf spring having a long tongue section extending from said male clasp member at a first end thereof and a short tongue section from said long tongue section at a second end thereof. Said short tongue section normally maintains an angular posture but resiliently deflective to lie flatly against said long tongue section. Said female clasp member has at least one peripheral wall forming a hollow body and an end wall to define an insertion chamber in cooperation with said hollow body. Said end wall is formed with a slot extending to permit insertion of said long and short tongue sections while flatly lying against each other and to divide said end wall into an upper wall section and a lower section. Further, a rigid floor member or a rigid folded plate member is provided within the insertion chamber for supporting the resilient detent member to prevent same from wobbling therewithin.

20 Claims, 3 Drawing Figures

CONNECTION FOR A JEWELRY BAND

BACKGROUND OF THE INVENTION

This invention relates to a connection for a jewelry band such as a necklace or a bracelet.

The connections of this kind have various shapes, such as flat and cylindrical shapes. Those using a leaf spring as disclosed in U.S. Pat. No. 4,170,809, however, have the disadvantage that although a reliable lock of two mate members can be ensured in no oblique force is exerted on one of the mate members, an oblique force, if applied to one of them would twist and detach an inserted resilient locking member.

SUMMARY OF THE INVENTION

The invention is directed to overcoming the disadvantages noted above, and provides a connection for a jewelry band, in which a female clasp member into which an male clasp member is inserted, has rigid support means to prevent wobbling of the end of the male clasp member in the female clasp member when the male clasp member is inserted therein.

DETAILED DESCRIPTION OF THE EMBODIMENTS

Figure 1:
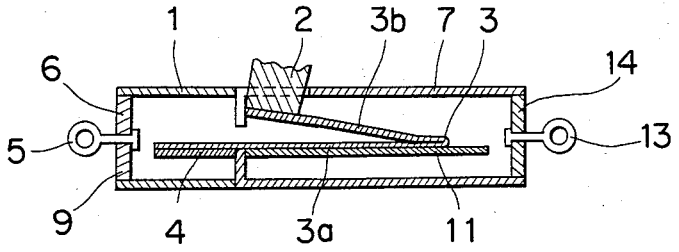
FIG. 1 is a sectional view showing a connection according to the invention.
Figure 2:
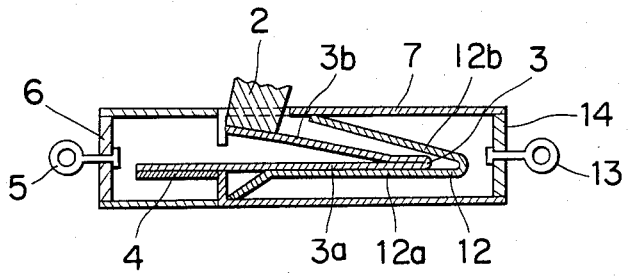
FIG. 2 is a sectional view showing a different embodiment of the connection according to the invention.
Figure 3:
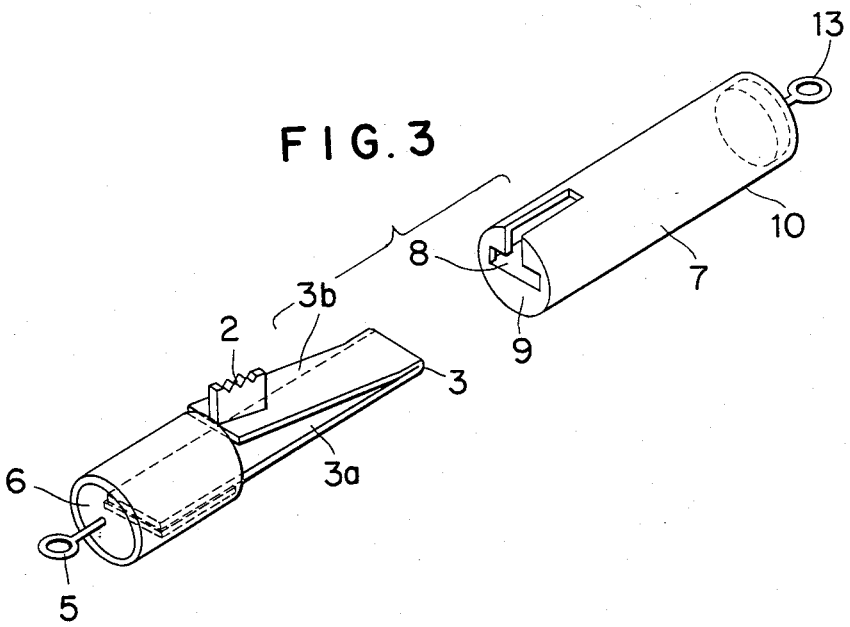
FIG. 3 is a perspective view showing the connection device of FIG. 1 in a separated state.

Referring to the drawings, a male clasp member 1 has a resilient detent member having the form of a folded leaf spring 3. Said folded leaf spring 3 has a long tongue section 3*a* secured at 4 to the male clasp member 1 at a first end thereof and extending therefrom. A short tongue section 3*b* extends from said long tongue section 3*a* at a second end thereof and normally maintains an angular posture. Section 3*b* is resiliently deflective in order to lie flatly against said long tongue section 3*a*, when so desired. Said leaf spring 3 has a push member 2 secured to said short tongue section 3*b*. A hook 5 for fastening a chain or the like is secured to the end member 6. A female clasp member 7 has a peripheral wall forming a hollow body 10 and an end wall defining an insertion chamber in said hollow body 10. An insertion slot 8 is formed in the end wall 9 and in the peripheral wall of body 10. Said slot 8 permits insertion of said long and short tongue sections, 3*a* and 3*b* respectively which lie flatly against each other when pushed together from above. The slot 8 divides said end wall 9 into two upper wall sections and one lower wall section. Referring to FIG. 1, there is provided within said insertion chamber a rigid floor member 11 which extends longitudinally therein from said lower wall section. Said lower wall section has a top surface and said rigid floor member 11 is substantially flush with said top surface. Referring to FIG. 2 which shows another embodiment of the invention, said rigid floor member is replaced with a rigid folded plate member 12 having a long arm section 12*a* extending longitudinally within said chamber from said lower wall section and a short arm section 12*b* extending at an angle with said long arm section 12*a* to receive said resilient detent member 3 therein. The hollow body 10 has an end wall 14 at the other end thereof and hook 13 is secured to said end wall 14 for fastening the chain or the like.

The function and effect of the invention will now be described.

By inserting the leaf spring 3 of the male clasp member 1 in the insertion chamber of the female clasp member 3 through slot 8, said short tongue section 3*b* is locked by the upper wall sections of the end wall 9. At this time, the long tongue section 3*a* of the leaf spring 3*b* is in contact with the rigid floor member 11 or the long arm section 12*a* of the folded plate member 12. Consequently, a force tending to twist the two members will not cause wobbling of the leaf spring 3 in the female clasp member 7. It is thus not only possible to eliminate accidental detachment of the two members from each other, due to otherwise possible casual detachment of the leaf spring 3 from the two upper wall sections of the female clasp member, but also to prevent resultant damage to the male and female members.

To disengage the two members from each other, the two members are pulled away from each other with the push member 2 held pushed down. The long tongue section 3*a* and short tongue section 3*b* effectively lie flatly against each other when the push member 2 is pushed downwardly. Furthermore, tongue section 3*a* lies on the rigid floor member 11 or plate 12 whereby removal of the leaf spring 3 from the female clasp member may be accomplished and the members 1 and 10 can be readily separated from each other.

While the above embodiment has concerned with a cylindrical structure, the invention is applicable as well to any other shape, e.g., a flat shape and a rectangular shape.

What is claimed is:

1. A connection for a jewelry band, comprising:

(a) a male clasp member;

(b) a resilient detent member in the form of a folded leaf spring having a long tongue section extending from said male clasp member at a first end thereof and a short tongue section extending from said long tongue section at a second end thereof to normally maintain an angular posture but resiliently deflective to lie flatly against said long tongue section;

(c) a female clasp member having at least one peripheral wall forming a hollow body and an end wall to define an insertion chamber in cooperation with said hollow body, said end wall being formed with a slot extending to permit insertion of said long and short tongue sections while flatly lying against each other and to divide said end wall into an upper wall section and a lower wall section;

(d) means for supporting said resilient detent member within said chamber to prevent said resilient detent member from wobbling therewithin; and, (e) said supporting means includes a rigid folded plate member having a long arm section extending longitudinally within said chamber from said lower wall section and a short arm section extending at an angle to said long arm section to receive said resilient detent member therein.

2. A connection for a jewelry band according to claim 1, wherein said lower wall section has a top surface, said long arm section being substantially flush with said top surface.

3. The connection as defined in claim 1, wherein:

(a) said hollow body is generally cylindrically-shaped.

4. The connection as defined in claim 1, wherein:
(a) said slot is generally T-shaped.

5. The connection as defined in claim 1, wherein:
(a) connection means are associated with each of said male and female clasp members and permit connection thereof with a jewelry band.

6. The connection as defined in claim 5, wherein:
(a) said connection means being coaxial.

7. The connection as defined in claim 5, wherein:
(a) each of said connection means disposed above said means for supporting.

8. The connection as defined in claim 3, wherein:
(a) said male clasp member includes a generally cylindrical portion; and,
(b) said detent member extends from said cylindrical portion.

9. The connection as defined in claim 5, wherein:
(a) said short arm section has a portion thereof engaged with said peripheral wall.

10. The connection as defined in claim 1, wherein:
(a) said long and short arm sections joined together at a point spaced from a second end wall of said female clasp member, said second end wall spaced from said first mentioned end wall.

11. A connection for a jewelry band or the like, comprising:
(a) a male clasp member;
(b) a resilient detent member in the form of a folded leaf spring having a long tongue section extending from said male clasp member at a first end thereof and a short tongue section extending from said long tongue section at a second end thereof to normally maintain an angular posture but resiliently deflective to lie flatly against said long tongue section;
(c) a female clasp member having at least one peripheral wall forming a hollow body and an end wall to define an insertion chamber in cooperation with said hollow body, said end wall being formed with a slot extending to permit insertion of said long and short tongue sections while flatly lying against each other and to divide said end wall into an upper wall section and a lower wall section;
(d) means for supporting said resilient detent member within said chamber to prevent said resilient detent member from wobbling therewithin;
(e) said supporting means includes a rigid floor member extending longitudinally within said chamber from said lower wall section; and,
(f) said lower wall section has a top surface and said rigid floor member is substantially flush with said top surface substantially over the length thereof.

12. The connection as defined in claim 11, wherein:
(a) said hollow body is generally cylindrical.

13. The connection as defined in claim 11, wherein:
(a) connection means associated with each of said clasp members permitting connection thereof with a jewelry band.

14. The connection as defined in claim 11, wherein:
(a) said connection means are coaxial.

15. The connection as defined in claim 12, wherein:
(a) said male clasp member includes a generally cylindrical portion; and,
(b) said detent member extends from said cylindrical portion.

16. A connection for a jewelry band or the like, comprising:
(a) a male clasp member having a resilient detent member extending from one end of said male clasp member;
(b) said detent member includes a long tongue section resiliently connected to a short tongue section and said interconnected tongue sections have a first angularly disposed position and a second position wherein said short tongue section is contiguously engaged over substantially the length thereof with said long tongue section;
(c) a female clasp member including a hollow body having a peripheral wall and an end wall defining an insertion chamber;
(d) a slot communicating with said insertion chamber disposed in said end wall and having a portion thereof extending a substantial distance from said end wall into said peripheral wall and dividing said end wall into upper and lower wall sections;
(e) said slot adapted to permit insertion therein of said tongue sections when said tongue sections are in said second position so that said tongue sections are received within said insertion chamber;
(f) said lower wall section having a top surface; and,
(g) rigid support means disposed in said insertion chamber having a longitudinally extending portion thereof planar substantially over the length thereof with said top surface and adapted for receiving thereon said long tongue section and to thereby prevent wobbling of said detent member when said tongue sections are in said first position.

17. The connection as defined in claim 16, wherein:
(a) said support means includes a floor member extending from said lower wall section.

18. The connection as defined in claim 16, wherein:
(a) said support means includes a rigid folded plate member having a longitudinally extending long arm section and a short arm section angularly extending from an end of said long arm section spaced from said end wall so that said tongue sections are received therein when in said first position.

19. The connection as defined in claim 16, wherein:
(a) said female clasp member being generally cylindrically-shaped; and,
(b) said male clasp member having a generally cylindrical portion and said detent member extends from said cylindrical portion.

20. The connection as defined in claim 16, wherein:
(a) a push member extends from said short tongue section through the slot portion in said peripheral wall when said tongue sections are in said first position in order to permit said tongue sections to be shifted from said first to said second position.

* * * * *

UNITED STATES PATENT AND TRADEMARK OFFICE

CERTIFICATE OF CORRECTION

PATENT NO. : 4,532,682

DATED : August 6, 1985

INVENTOR(S) : Masami Murao

It is certified that error appears in the above-identified patent and that said Letters Patent is hereby corrected as shown below:

On the title page, Item /73/, should read

-- Kabushiki Kaisha Murao --.

Signed and Sealed this

*Twenty-sixth* Day of *November 1985*

[SEAL]

*Attest:*

DONALD J. QUIGG

*Attesting Officer*

*Commissioner of Patents and Trademarks*